United States Patent [19]

Keeton

[11] Patent Number: 4,478,163

[45] Date of Patent: Oct. 23, 1984

[54] DUAL EXPOSURE HOT WIRE CUTTER

[76] Inventor: John H. Keeton, P.O. Box 296, Campbellsville, Ky. 42718

[21] Appl. No.: 426,145

[22] Filed: Sep. 28, 1982

[51] Int. Cl.[3] ..... D05B 65/06

[52] U.S. Cl. ..... 112/287; 112/290; 112/299

[58] Field of Search ..... 112/290, 287, 288, 285, 112/DIG. 1, DIG. 2, DIG. 3, 300, 301, 299

[56] References Cited

U.S. PATENT DOCUMENTS

| | | | |
|---|---|---|---|
| 3,125,052 | 3/1964 | Spivey | 112/290 |
| 3,191,562 | 6/1965 | Frankel | 112/290 |
| 3,217,680 | 11/1965 | Harris, Jr. et al. | 112/290 X |
| 3,934,526 | 1/1976 | Damast et al. | 112/290 X |
| 4,220,105 | 9/1980 | Palacino | 112/287 |
| 4,419,950 | 12/1983 | Keeton | 112/290 |

*Primary Examiner*—H. Hampton Hunter

*Attorney, Agent, or Firm*—Cushman, Darby and Cushman

[57] ABSTRACT

A cutting assembly allows efficient automatic cutting of synthetic thread, and also allows manual cutting thereof. A guide block has a bottom surface past which cloth is adapted to move in a direction A, and a narrow channel is formed in the block substantially parallel to the direction A. A vacuum cut-thread removal passageway is formed in the block at the channel leading end and in operative communication with the channel, the passageway being elongated in a dimension intersecting the channel. A notch is formed in the block adjacent, but spaced from, the channel leading end and vacuum passageway. A wire of electrically conductive material is mounted so that it extends through the notch and channel and cuts thread moved into contact with it. An integral block having particular passageways formed therein provides a venturi arrangement adjacent the vacuum passageway to provide the vacuum source.

12 Claims, 7 Drawing Figures

DUAL EXPOSURE HOT WIRE CUTTER

BACKGROUND AND SUMMARY OF THE INVENTION

The invention relates to a cutting assembly for cutting thread, and is particularly adapted for use with automatic sewing machines for cutting synthetic stitching thread after sewing with such machines. Conventional hot wire cutters in the textile industry, particularly those utilized with automatic sewing machines, have a number of drawbacks associated therewith, which the present invention is designed to overcome.

Conventional automatic hot wire cutters utilize a vacuum source to effect removal of severed stitching thread, and cause the thread to move over the hot cutting wire. The hot wires in such cutters typically do not operate ideally, however, since they either operate too cooly, so they do not effect the cutting action properly, or if the current therethrough is increased substantially they burn up too quickly. It has been found — according to the present invention — that the location of the hot wire directly in the primary stream of air flowing into the vacuum conduit results in this less-than-ideal operation.

Also, conventional cutters are either manual or automatic, and this limits their versatility and utilization for some operations. For those operations where an automatic action will be required at sometimes, but manual passage of thread into contact with the hot wire during related functions is desirable, the prior art has failed to provide a satisfactory alternative.

Further, conventional hot wire cutting assemblies utilizing a vacuum source provide the vacuum source at a location remote from the cutting action, and the vacuum-providing structures normally are relatively cumbersome and difficult to deal with.

According to the present invention a cutting assembly for cutting thread, and particularly adapted for utilization in textile operations with automatic sewing machines for cutting synthetic stitching thread, is provided that overcomes the limitations and drawbacks inherent in the prior art.

According to one aspect of the present invention, the cutting assembly is provided including a guide block having a bottom surface for movement of cloth therepast in a direction A, with a means defining a narrow channel in the guide block substantially parallel to the direction A, the channel being open at the bottom surface and having a trailing end and a leading end spaced from each other in the direction A. Means are provided defining a vacuum cut-thread removal passageway in the block at the channel leading end, and in operative communication with the channel, the passageway being elongated in the dimension intersecting the channel. A first wire portion of electrically conductive material is adapted to be connected to a source of e.m.f., and means are provided for mounting the wire portion in the channel spaced from the channel bottom so that the wire extends into the channel generally perpendicular to the direction A adjacent, but spaced from, the intersection of the channel and the vacuum passageway, out of the primary flow of air into the vacuum passageway. By mounting the wire portion out of the primary flow of air, it does not have a tendency to cool as rapidly as if mounted in the primary flow of air, and thus the energy supply thereto can be minimized while effective cutting action is provided.

According to another aspect of the present invention, the cutting assembly provides a dual-exposure of the cutting wire, allowing both automatic and manual cutting to be performed therewith. Means are provided defining a notch in the block adjacent, but spaced from, the channel leading end, the notch including an open bottom and end.

The means for mounting the wire mount it so that it also extends into the notch so that thread may be moved into the notch through the bottom and/or end into contact with the wire to be severed thereby. Mounting of the wire can be accomplished in a simple manner which allows adjustability of the spacing of the wire from the channel bottom, to thereby vary the length of the stitching thread being cut that remains with the cloth (i.e. the remaining nub). The block may be of metal, and a ground screw may attach one end of the wire to the block, the block being connected to ground. In that way only one wire need lead to the block.

Vacuum withdrawal of cut thread is provided in a simple and effective manner. A relatively short vacuum conduit is in operative communication with the vacuum passageway, and is connected to a first, through-passageway in a small integral component block mounted close to the guide block. A second passageway is formed in the block, intersecting the first passageway, and a third, blind passageway is provided in the block having a fitting at the end thereof adapted to be connected to a source of air under pressure. The intersection between the second and first passageways is such that air flowing through the third passageway, and second passageway, into the first passageway, moves away from the guide block, thereby providing a vacuum in the vacuum conduit and vacuum passageway. A conduit extending from the integral block first passageway, opposite the vacuum conduit, eventually deposits the withdrawn thread into a waste receptacle.

It is the primary object of the present invention to provide a simple, effective, and versatile cutting assembly for cutting thread. This and other objects of the invention will become clear from an inspection of the detailed description of the invention and from the appended claims.

DETAILED DESCRIPTION OF THE DRAWINGS

Figure 1:
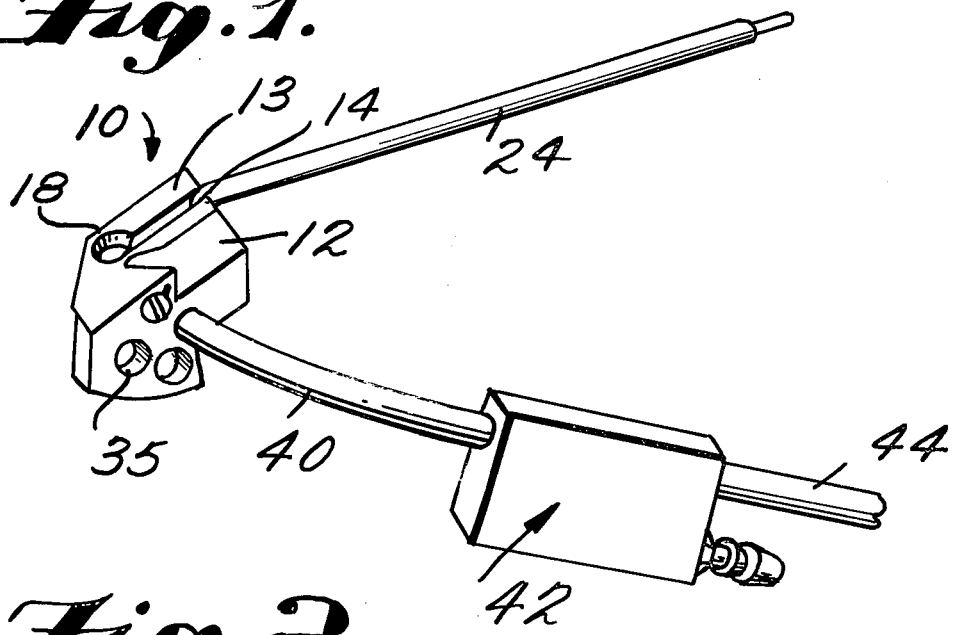
FIG. 1 is a bottom perspective view of an exemplary cutting assembly according to the present invention.
Figure 6:
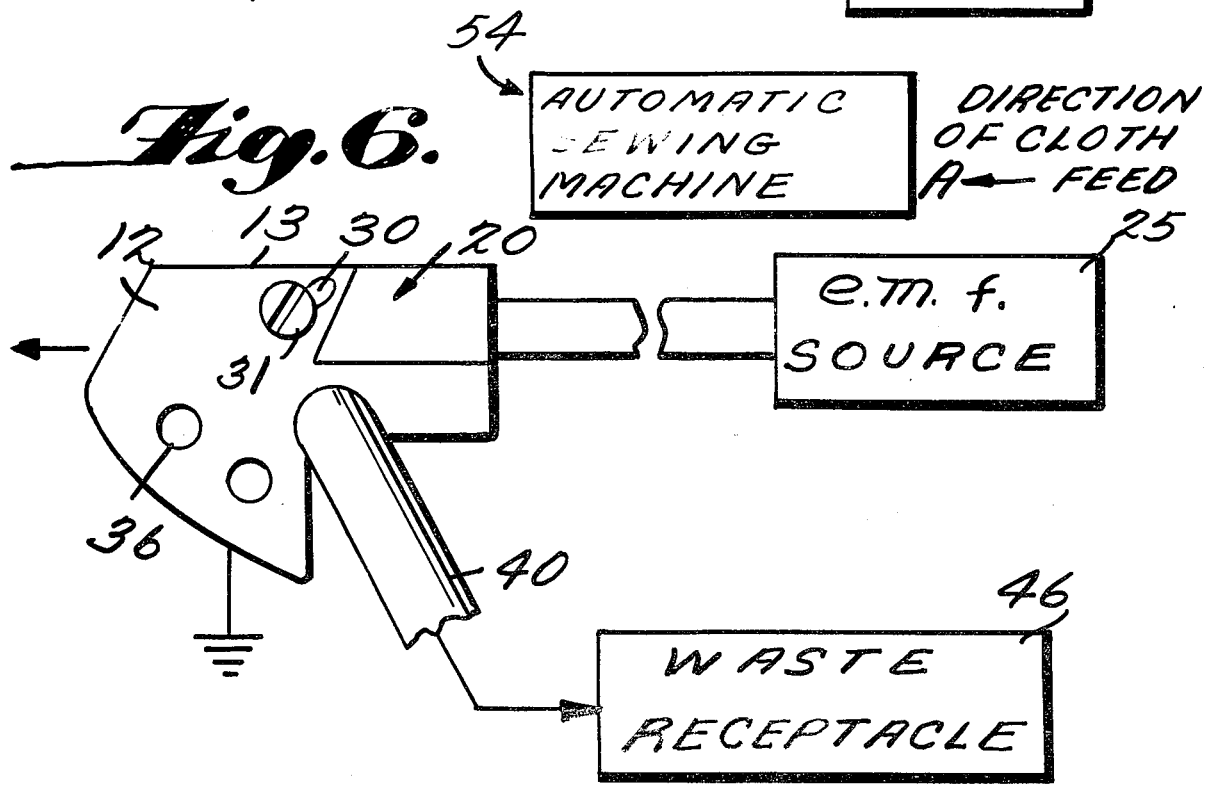
FIG. 6 is a schematic side view of the guide block of FIGS. 2 through 4, viewed in the direction of arrow D of FIG. 3, showing the guide block inverted (upside-down), for clarity of illustration, in operative association with an automatic sewing machine, e.m.f. source, and waste receptacle.

An exemplary cutting assembly according to the present invention is shown generally by reference numeral 10 in FIG. 1. The main component of the assembly 10 comprises a guide block having a bottom surface 13 adapted to provide movement of cloth therepast in a direction A. This is best seen with respect to the exemplary form illustrated in FIGS. 6 and 7 wherein the block 12 is mounted adjacent the exit from an automatic sewing machine.

Figure 2:
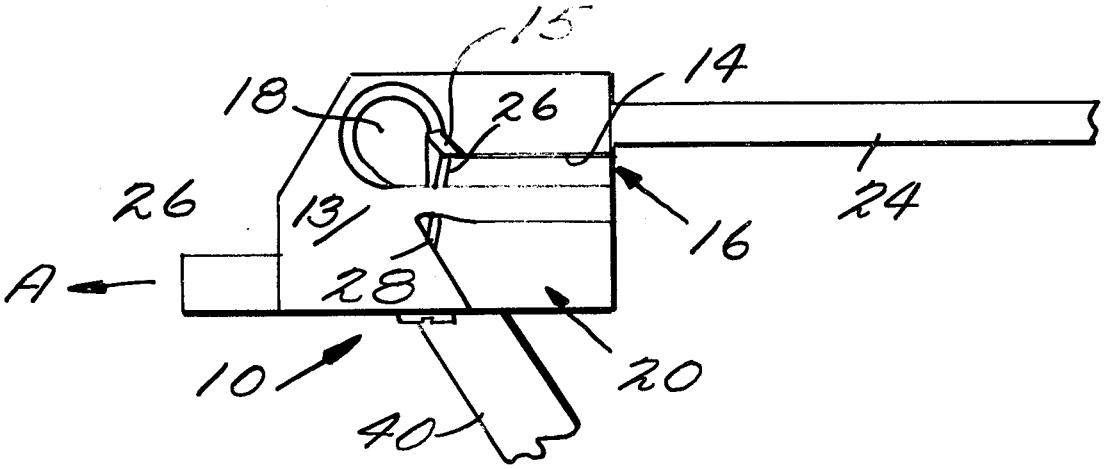
FIG. 2 is a bottom plan view particularly illustrating the guide block of the assembly of FIG. 1.

The guide block 12, which preferably is formed of metal, includes means defining a relatively shallow, narrow, channel 14 therein. The channel 14 is substantially parallel to the direction A and is open at the bottom surface 13, and has an open leading end 15 and an open trailing end 16 (see FIG. 2 in particular). The ends 15, 16 are spaced from each other in the direction A. The channel is wide enough to allow ready thread T (see FIG. 3) passage therethrough but narrow enough so that no portion of the cloth C to which the synthetic stitching thread T is attached will pass into contact with a hot cutting wire disposed in the channel 14.

Means are also provided defining a vacuum cut-thread removal passageway 18 in the block 12 at the channel leading end 15 and in operative communication with the channel 14. The passageway 18 is elongated in a dimension intersecting the channel 14.

The cutting assembly according to the invention further comprises a wire 24 of electrically conductive material adapted to be connected to a source of e.m.f. 25. The wire 24 includes a first portion 26, and means for mounting the portion 26 in the channel 14 (see FIGS. 2 and 3 in particular) so that it extends generally perpendicular to the direction A adjacent, but spaced from, the intersection of the channel 14 and the vacuum passageway 18, and out of the primary flow of air into the vacuum passageway 18. In this way the effective cutting life of the wire 24 is increased.

The channel 14 passageway 18, and wire portion 26, comprise a portion of the cutting assembly adapted for automatic cutting of stitching thread or the like, such as thread T associated with a piece of cloth C exiting an automatic sewing machine 54 or the like. There are some operations, however, where manual cutting is desirably performed. For instance after the piece of cloth C exits the automatic sewing machine, there may be other thread portions associated therewith, aside from that passing in that channel 14, which are to be cut.

According to the present invention the cutting assembly 10 is made versatile so as to provide for the manual cutting of thread, in addition to the automatic cutting thereof. This is accomplished according to the present invention by providing means defining a V-shaped notch 20 in the block 12 adjacent, but spaced from, the channel leading end 15. The notch includes an open bottom and end as is clearly seen in FIGS. 1 through 3. A second portion 28 of wire 24 is associated with notch 20, means being provided for mounting the portion 28 in the notch 20 so that thread may be moved into the notch 20 through the open bottom and/or end thereof into contact with the second wire portion 28, to be severed thereby.

Figure 3:
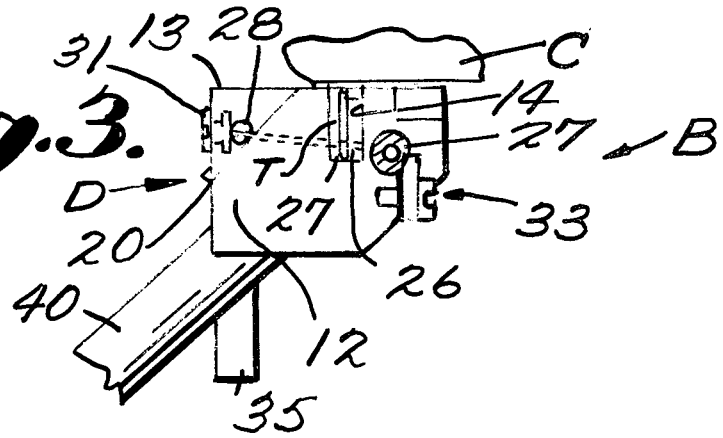
FIG. 3 is a trailing-end view of the guide block of FIG. 2 shown inverted (upside-down) for clarity of illustration.
Figure 4:
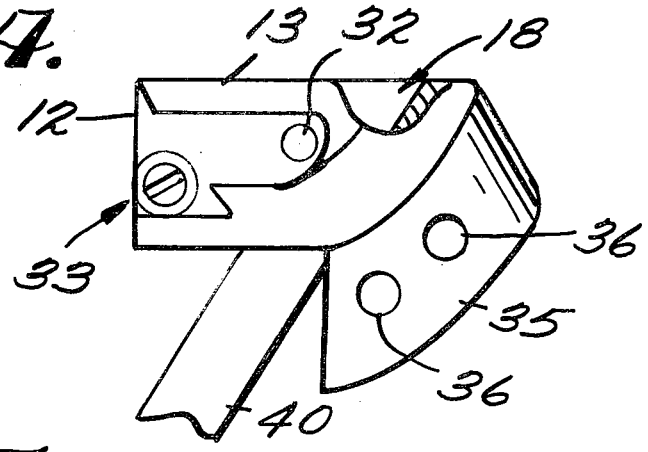
FIG. 4 is a side view, looking in the direction of arrow B of FIG. 3, of the guide block.

The means for mounting the first and second wire portions 26, 28 comprises means defining a bore extending through the block 12 generally perpendicular to the direction A, the bore extending generally in the direction of arrows B and D in FIG. 3. An open end 30 (see FIG. 6) of the bore adjacent to notch 20 receives the portion 28 of wire 24, and the wire is held stationarily in the opening 30 by a metal set screw 31 or the like, in threaded engagement with the block 12 and engaging the wire portion 28. At the end of the bore adjacent the channel leading end 15 an enlarged opening 32 (see FIG. 4) is provided. (In FIG. 4 the wire 24 is not shown for clarity of illustration).

Means are provided for frictionally engaging the wire 24 adjacent the opening 32 such means preferably comprising a screw and washer assembly 33 (see FIG. 4), the screw being threaded into the side of the block 12 and the spacing of the washer from the side of the block 12 thus being adjustable. By positioning the wire within the opening 32, and then frictionally engaging it with the screw and washer assembly 33 to hold it in the position to which it has been moved, the position of the wire portion 26 with respect to the top 27 of the channel 14 (see FIG. 3) may be adjusted. This allows for the length of the "nub" of thread T attached to the cloth C after cutting to be adjustable. Preferably the opening 32 is large enough to allow adjustment a distance corresponding to one complete stitch of the stitching thread T.

Figure 7:
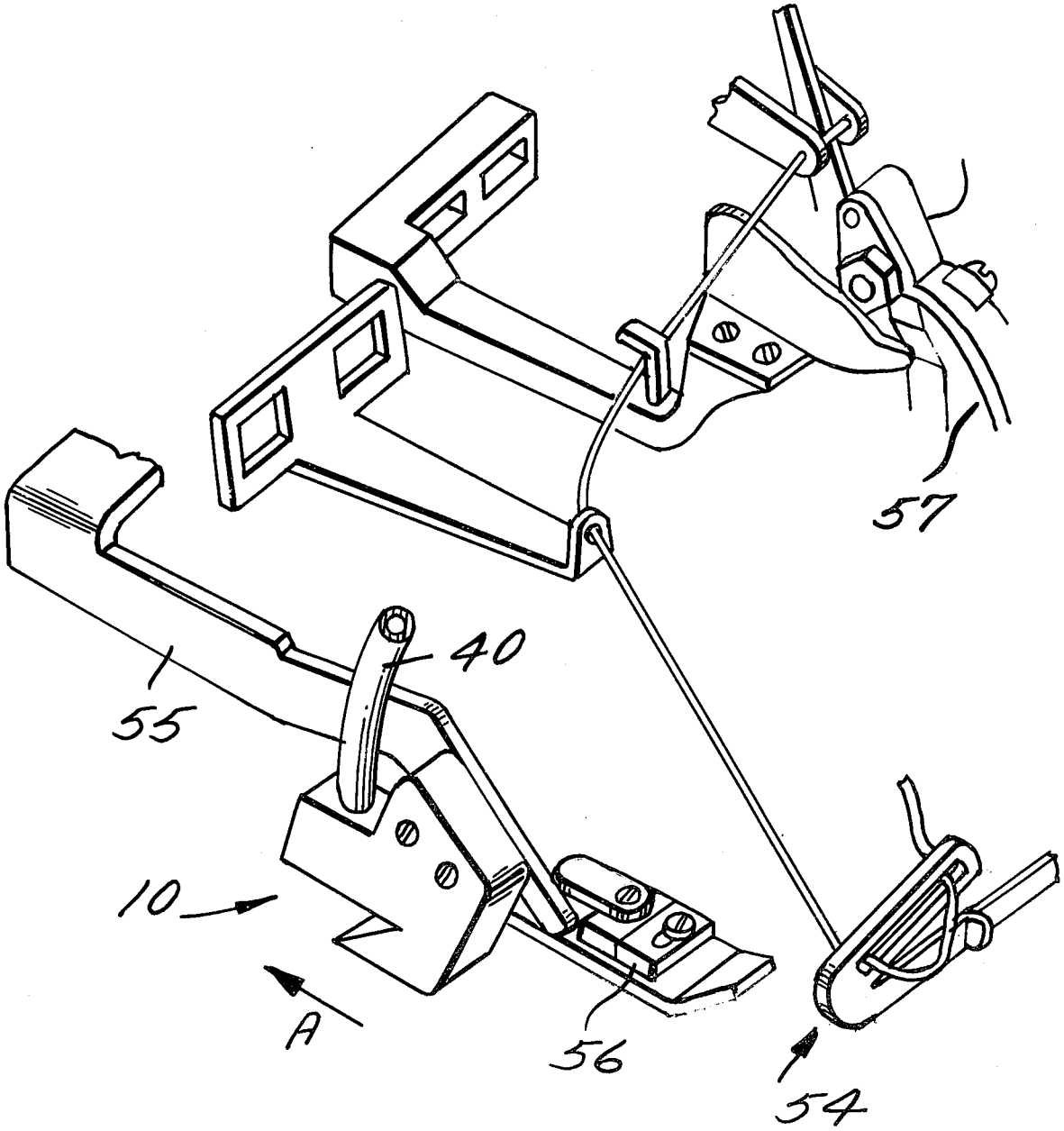
FIG. 7 is a schmetic perspective view showing the cutting assembly mounted in association with a conventional automatic sewing machine presser arm and foot.

The block 12 may be readily connected up to a stationary component in a desired position utilizing the mounting bracket 35 integral therewith, by passing screws (or other fasteners) through openings 36 formed in the mounting bracket 35. Preferably the bracket 35 will be mounted to a large metal object, such as a frame for cloth handling equipment, so that the block 12, and the object to which it is connected, provide an electrical ground for the wire 24 (see FIG. 6). The position of the block 12 is most desirably adjacent the exit of a conventional automatic sewing machine 54, although other locations may be provided depending upon the desired end use. As seen in FIG. 7, it is preferably mounted on the bottom of a presser arm 55 of machine 54 so that thread T from cloth C will be sucked up into channel 14 as the cloth passes past presser foot 56, and needle 57, exiting automatic sewing machine 54.

Figure 5:
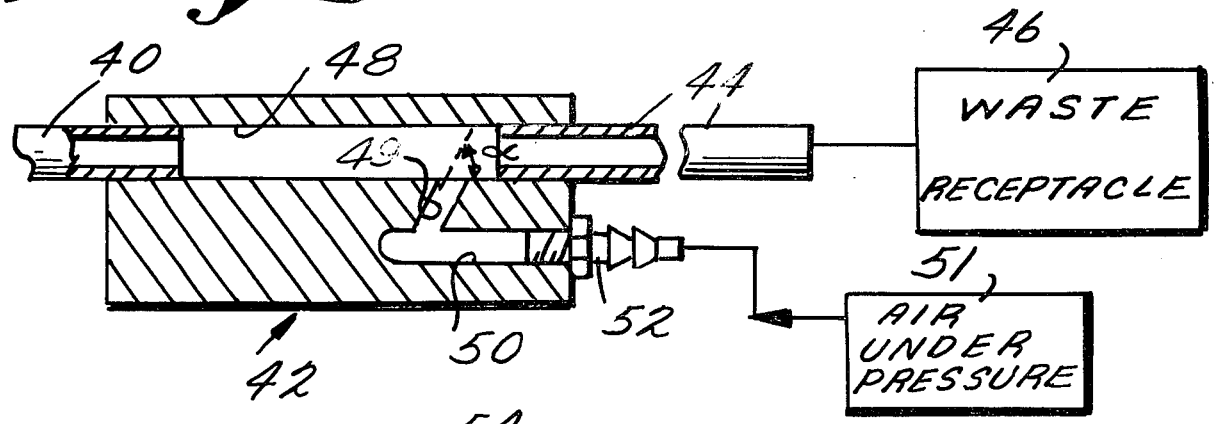
FIG. 5 is a longitudinal cross sectional view of an exemplary integral venturi block of the cutting assembly FIG. 1.

The vacuum removal system according to the present invention also is particularly advantageous. A vacuum conduit 40, such as an aluminum tube, is inserted into the passageway 18, in operative communication therewith and extends away from the block 12 to an integral block 42 which provides a venturi effect, providing the source of suction for withdrawing thread through the passageway 18. This block 42, which is illustrated in FIG. 5, has an exit conduit 44 (which also may be an aluminum tube) extending from the opposite side of the block 42 as a conduit 40, and in-line therewith. The conduit 44 ultimately leads to a suitable waste receptacle 46.

The block 42 includes means defining a first passageway 48 therein, means defining a second passageway 49 intersecting the first passageway 48, and means defining a third, blind, passageway 50 intersecting the second passageway 49. The orientation of the second passageway 49 with respect to the first passageway 48 is such that an angle of less than 90° between the passageway 49 and the passageway 48 is provided, the passageway 49 being slanted toward the tube 44. The third passageway 50 is connected up to a source 51 of air under pressure, as by providing a conventional fitting 52 in screw-threaded engagement with the block 42 at passageway 50. The block 42 preferably is made of aluminum, while the fitting 52 is of any conventional material.

Exemplary apparatus according to the present invention having been described, the typical manner of utilization thereof will now be set forth:

A free end of wire 24 is passed through openings 32, 30 in the block 12, and the free end is tightened down with screw 31, that end of the wire 24 being held stationary with respect to the block 12. The position of the wire 24 within the opening 32 is adjusted depending upon the length of thread T nub to remain after cutting, and the screw-washer assembly 33 is tightened down to frictionally engage the wire 24 and clamp it against the wall of the block 12 to hold it in the position to which it was moved. Screws are passed through openings 36 in mounting bracket 35 to mount the block 12 adjacent the exit of an automatic sewing machine 54, such as to presser arm 55, so that the bottom surface 13 of block 12 has movement of cloth C therepast in the direction A, thread T being sucked into channel 14 and passageway 18.

Vacuum conduit 40 is pressed into vacuum passageway 18, and air under pressure is supplied from source 51 to the venturi block 42, a suction being provided to draw a primary flow of air, and any cut thread, through the passageway 18, ultimately to exhaust into waste receptacle 46.

Current is supplied to the wire portions 26, 28 by the source of the e.m.f. 25, and then operation of the automatic sewing machine 54 is effected. Cloth C being conveyed away from the the automatic sewing machine 54 has a depending thread T portion, which automatically passes into channel 14 and is automatically brought into contact with wire cutting portion 26, the cut off portion of the thread T being removed through vacuum passageway 18. When it is desired to trim thread portions from the cloth C manually, the cloth and thread are grasped, and the thread is manually moved into the open bottom or end of V-notch 20, into contact with wire portion 28, thereby being severed.

It will thus be seen that according to the present invention a simple, versatile, and effective hot wire cutting assembly has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A cutting assembly for cutting thread, comprising:

a guide block having a bottom surface for movement of cloth therepast in a direction A;

means defining a narrow channel in said guide block substantially parallel to said direction A, said channel being open at said bottom surface, and having a trailing end and a leading end spaced from each other in the direction A;

means defining a vacuum cut-thread removal passageway in said block at said channel leading end, and in operative communication with said channel, said passageway elongated in a dimension intersecting said channel;

a wire portion of electrically conductive material adapted to be connected to a source of e.m.f.; and means for mounting said wire portion in said channel, spaced from the channel top, so that said wire extends in said channel generally perpendicular to said direction A adjacent, but spaced from, the intersection of said channel and said vacuum passageway, out of the primary flow of air into the vacuum passageway.

2. An assembly as recited in claim 1 further comprising means defining a notch in said block adjacent, but spaced from, said channel leading end and said vacuum passageway, said notch including an open bottom and end; a second wire portion of electrically conductive material adapted to be connected to a source of e.m.f.; and means for mounting said second wire portion in said notch so that thread may be moved into said notch through said open bottom and/or end into contact with said second wire portion, to be severed thereby.

3. An assembly as recited in claim 2 wherein said wire portion and said second wire portion are part of the same integral wire.

4. An assembly as recited in claim 3 wherein said means for mounting said wire comprises a bore extending through said block substantially perpendicular to said direction A, and intersecting said channel and said notch; said bore having an open end adjacent said channel substantially larger than the cross-sectional area of said wire; means for fixedly mounting said wire adjacent an open end of said bore adjacent said notch; and means for frictionally engaging said wire adjacent said bore open end adjacent said channel, so that the position of said wire with respect to the top of said channel may be adjusted.

5. An assembly as recited in claim 4 wherein said means for fixedly mounting said wire adjacent said open end of said bore adjacent said notch comprises a metal grounding screw; and wherein said guide block is made of electrically conductive material and is grounded, thereby providing a ground for said wire.

6. An assembly as recited in claim 1 wherein said trailing end of said channel is open.

7. An assembly as recited in claims 1 or 2 further comprising a first conduit connected to said vacuum passageway and extending outwardly from said guide block; and an integral vacuum-producing component attached to said conduit close to said guide block, said integral component including: means defining a first major passageway therethrough in alignment with said first conduit, and having a second conduit extending outwardly therefrom from the opposite side as said conduit; means defining a second passageway in said integral component intersecting said first passageway and angled toward said second conduit; means defining a third, blind, passageway in said integral component intersecting said second passageway, but not said first passageway; and means for interconnecting said third passageway to a source of air under pressure, air under pressure flowing through said third, second, and first passageways effecting formation of a vacuum in said vacuum passageway, and exhausting air and thread from said vacuum passageway.

8. A cutting assembly for cutting thread comprising:

a guide block having a bottom surface for movement of cloth therepast in a direction A;

means defining a narrow channel in said guide block substantially parallel to said direction A, said channel being open at said bottom surface, and having a trailing end and a leading end spaced from each other in the direction A;

means defining a vacuum cut-thread removal passageway in said block at said channel leading end, and in operative communication with said channel, said passageway elongated in a dimension intersecting said channel;

means defining a notch in said block adjacent, but spaced from, said channel leading end and said vacuum passageway, said notch including an open bottom and end;

a wire of electrically conductive material adapted to be connected to a source of e.m.f.; and means for mounting said wire in said notch and said channel so that thread in said notch or said channel can be brought into contact with said wire, and severed thereby.

9. An assembly as recited in claim 8 wherein said channel trailing end is open.

10. An assembly as recited in claim 8 wherein said means for mounting said wire comprises a bore extending through said block substantially perpendicular to said direction A, and intersecting said channel and said notch; said bore having an open end adjacent said channel substantially larger than the cross-sectional area of said wire; means for fixedly mounting said wire adjacent an open end of said bore adjacent said notch; and means for frictionally engaging said wire adjacent said open end thereof adjacent said channel, so that the position of said wire with respect to the top of said channel may be adjusted.

11. An assembly as recited in claim 10 wherein said means for fixedly mounting said wire adjacent said open end of said bore adjacent said notch comprises a metal grounding screw; and wherein said guide block is made of electrically conductive material and is grounded, thereby providing a ground for said wire.

12. An assembly as recited in claim 8 further comprising a first conduit connected to said vacuum passageway and extending outwardly from said guide block; and an integral vacuum-producing component attached to said conduit close to said guide block, said integral component including means defining a first, major passageway therethrough in alignment with said first conduit, and having a second conduit extending outwardly therefrom from the opposite side as said conduit; means defining a second passageway in said integral component intersecting said first, passageway and angled toward said second conduit; means defining a third, blind, passageway in said integral component intersecting said second passageway, but not said first passageway; and means for interconnecting said third passageway to a source of air under pressure flowing through said third, second, and first passageways effecting formation of a vacuum in said vacuum passageway, and exhausting air and thread from said vacuum passageway.

* * * * *